US006552710B1

(12) United States Patent
Shimizu et al.

(10) Patent No.: US 6,552,710 B1
(45) Date of Patent: Apr. 22, 2003

(54) DRIVER UNIT FOR DRIVING AN ACTIVE MATRIX LCD DEVICE IN A DOT REVERSIBLE DRIVING SCHEME

(75) Inventors: Nobuo Shimizu, Shiga (JP); Yasuhiro Kosaka, Shiga (JP)

(73) Assignee: NEC Electronics Corporation, Kanagawa (JP)

( * ) Notice: Subject to any disclaimer, the term of this patent is extended or adjusted under 35 U.S.C. 154(b) by 0 days.

(21) Appl. No.: 09/578,499

(22) Filed: May 26, 2000

(30) Foreign Application Priority Data

May 26, 1999 (JP) ..... 11-145754

(51) Int. Cl.[7] ..... G09G 3/36
(52) U.S. Cl. ..... 345/100; 345/98
(58) Field of Search ..... 345/98, 100

(56) References Cited

U.S. PATENT DOCUMENTS 4,667,178 A * 5/1987 Ryu ..... 341/136
5,402,127 A * 3/1995 Toda ..... 341/154
5,940,059 A * 8/1999 Lee et al. ..... 345/91
5,966,603 A * 10/1999 Eitan ..... 438/258
6,075,507 A * 6/2000 Miyahara et al. ..... 345/89
6,097,362 A * 8/2000 Kim ..... 345/87
6,304,241 B1 * 10/2001 Udo et al. ..... 345/96
6,353,425 B1 * 3/2002 Mosier ..... 345/88

FOREIGN PATENT DOCUMENTS

JP 10-308800 11/1998
JP 10-335615 12/1998
JP 2000137459 A * 5/2000
JP 2001037459 A * 5/2000

OTHER PUBLICATIONS

Microsoft Computer Dictionary, 4th ed., Microsoft Press, 1999, p. 362.*

* cited by examiner

*Primary Examiner*—Steven Saras
*Assistant Examiner*—Leland R. Jorgensen
(74) *Attorney, Agent, or Firm*—McGinn & Gibb, PLLC

(57) ABSTRACT

A horizontal driver in a LCD driver includes a D/A converter having a PROM decoder block and an NROM decoder block for driving a LCD panel in a dot reversible driving scheme. Each data line receives alternately a gray-scale signal having a positive polarity generated by a PROM decoder and a gray-scale signal having a negative polarity generated by an NROM decoder, and an odd-numbered data line and an even-numbered data line receive gray-scale signals having opposite polarities. The order of the decoders is matched by a switching block with the order of the data lines by switching the display data and the gray-scale signals.

20 Claims, 8 Drawing Sheets

DRIVER UNIT FOR DRIVING AN ACTIVE MATRIX LCD DEVICE IN A DOT REVERSIBLE DRIVING SCHEME

BACKGROUND OF THE INVENTION

1. Field of the Invention

The present invention relates to a driver unit for driving an active matrix LCD device in a dot reversible driving scheme and, more particularly, to a structure of the horizontal driver in the driver unit.

2. Description of the Related Art

Active matrix LCD devices are now used in a variety of applications due to their advantages of light weight, low operating voltage, low power dissipation and small thickness. FIG. 1 shows a conventional active matrix LCD module including a drive unit 200 in a dot reversible driving scheme.

The LCD panel 100 includes front and rear panels sandwiching therebetween liquid crystal. The rear panel has a plurality of pixel elements arranged in a matrix and each including a TFT (thin film transistor) and a pixel electrode, whereas the front panel has a common electrode and color filters. The rear panel includes a plurality of gate lines arranged in a vertical direction and each extending in a horizontal direction for driving the gates of TFTs arranged in a row, and a plurality of data lines arranged in the horizontal direction and each extending in the vertical direction for supplying display data to the pixels arranged in a column direction.

The drive unit 200 includes a vertical driver 210 fro driving the gate lines and a horizontal driver 220 for driving the data lines. When the vertical driver 210 supplies a scanning signal to a horizontal gate line for turning on the corresponding TFTs in the row, and the horizontal driver supplies a display data to each of the vertical data lines, an analog display signal is supplied to the pixel electrode through a corresponding TFT, whereby an electric field is applied to the liquid crystal between the pixel electrode and the common electrode. The electric field generates a chemical change in the liquid crystal for displaying an image based on the display data.

Assuming that the LCD panel defines 1024 (horizontal)× 768 (vertical) pixels therein, the configurations of the vertical driver 210 and the horizontal driver 220 are such that:

(1) the horizontal driver drives 3072 (3×1024) data lines each assigned for red, green and blue, and includes eight cascaded driving sections each having a function fro driving 384 data lines and arranged at the top of the LCD panel; and (2) the vertical driver drives 768 gate lines and includes four cascaded driving sections each having a function for driving 192 gate lines and arranged at one side of the Lcd panel.

Each of the vertical and horizontal drivers 210 and 220 is implemented on a single IC chip, which is mounted on a TCP (tape carrier package) and disposed with the longer sides thereof being parallel to a corresponding side of the LCD panel.

The horizontal driver 220, such as shown in FIG. 2, delivers display data to the data lines S1 to S384 including R, G and B color data having a positive or negative polarity with 64 gray-scale levels so that each data line S1 to S348 receives an alternate driving signal, and so that an odd-numbered data line S1, S3, S5, . . . and an even-numbered data line S2, S4, S6, . . . receive driving signals having different polarities in each horizontal period.

The horizontal driver 220 includes a shift register 221, a data register block 222, a latch block 223, a level shifter block 224, a D/A converter block 225 and an output stage block 226 including voltage followers. The shift register 221 is a 64-bit bi-directional register, which responds to a direction selection signal to select a right-shift operation or a left-shift operation for shifting a start pulse. The direction of the shift pulse is determined during the initial adjustment of the device. The shift register 221 reads a high level of a start pulse at a rising edge of a clock signal, generates successive control signals for the data register block 222 by shifting the start pulse, and delivers the control signals for controlling the data register 222 to receive input display data.

A group of six 6-bit data registers in the data register block 222 reads 6-bit display data at a time based on the control signals of the shift register 221. Each latch in the data latch block 223 responds to a rising edge of a latch control signal to latch the display data from the data register block 222, whereby the data latch block 222 delivers the display data for one row in a horizontal period through the level shifter block 224 to the D/A converter block 225. The D/A converter block 225 generates 64-level gray-scale voltages having a positive polarity and 64-level gray-scale voltages having a negative polarity in a gray-scale voltage generator of D/A converter block 225, consecutively selects one of the gray-scale voltages based on a display data by using a ROM decoder thereof, and delivers a gray-scale signal having a selected one of the gray-scale voltages through the voltage follower 226 as a driving voltage for driving each data line. The driving voltages for the data lines are such that each odd-numbered data line S1, S3, S5, . . . and each even-numbered data line S2, S4, S6, . . . are driven by the driving voltages having different polarities in each horizontal period, and each data line S1 to S348 receives alternately a positive-polarity signal and a negative-polarity signal in each horizontal period.

Referring to FIG. 3, a semiconductor chip 301 implementing the horizontal driver 220 of FIG. 2 and mounted on a TCP is exemplified. The horizontal driver 220 has a function for driving 384 data lines, for example. The semiconductor chip 301 has a rectangular shape in the top plan view thereof, and includes the horizontal driver 220 as an internal circuit 302. The semiconductor chip 301 has output pads (not depicted) consecutively disposed on the side near the LCD panel for driving the data lines S1, S2, . . . S384 therein, input pads disposed on the side opposing the output pads for receiving the start pulse, shift direction switching signal, clock signal, input data, and latch control signal, and power source pads arranged adjacent to the input pads for receiving power sources and γ-correction sources. The output pads may be disposed at the shorter sides of the semiconductor chip 301.

Referring to FIG. 4, therein shown an example of the internal circuit 302, which is depicted to drive six data lines S1 to S6 out of 384 data lines as an abbreviation.

The internal circuit 302 includes a shift register 311, one stage of which corresponds to the number (six in this case) of data lines S1 to S6, a data register block 312 having registers in number (6) corresponding to the number of data lines S1 to S6, a first switch block 313 having three 2-input/2-output switches each for exchanging outputs from a pair of registers in the data register block 312, a latch block 314 having latch cells each for latching data output from the first switch block 313, a level shifter block 315 having level shifters each for level-shifting an output from the latch block 314, a D/A converter block 317 having three 2-input/2-output switches each for exchanging outputs from a pair of converter cells in the D/A converter block 316, and an output stage block 318 having voltage followers for transferring an output from the second switch block 317. These circuit elements in each circuit clock are consecutively arranged in the vicinity of the longer side of the semiconductor chip 301 near the LCD panel conforming to the arrangement of the data lines.

In operation of the internal circuit 302, if a right-shift operation, for example, is selected in the shift register 311, the shift register 311 reads a high level of the start pulse at a rising edge of the clock signal for each horizontal period, and delivers the start pulse toward the next stage disposed at the right hand side in the internal circuit 302. At the same time, the control signals for receiving data are also delivered to the registers in the data register block 312. The data register block 312 receives 6-bit display data by the registers therein based on the control signal supplied from the shift register 311 for each horizontal period. The display data receive in the i-th (odd-numbered) registers (i=,1 3, 5,) are delivered to the first input of the switches whereas the display data received in the (i+1)th (even-numbered) registers are delivered to the second input of the switches. The first switch block 313 alternately delivers the data received from the first inputs and the second inputs of the switches to the i-th and (i+1)th latches, respectively, in the latch blocks 314.

The latch block 314 delivers the latched display data at a time through the level shifter block 315 to the D/A converter block 316 at the rising edge of the latch control signal. The D/A converter block 316 receives the display data at the inputs of converter cells, i.e., N-ROM decoders 316N and P-ROM decoders 316P disposed therein. The D/A converter block 316 generates gray-scale level signals each having a negative polarity based on the display data received by the N-ROM decoders 316N, and delivers the gray-scale level signals to the first inputs of the switches in the second switch block 317. The D/A converter block 316 generates gray-scale level signals each having a positive polarity based on the display data received by the P-ROM decoders 316P, and delivers the gray-scale level signals to the second inputs of the switches in the second switch block 317.

The second switch block 317 delivers the gray-scale level signals to the voltage followers in the output stage block 318 so that gray-scale level signals having the negative polarity and the positive polarity are alternately delivered and that each i-th voltage follower for i=1, 3 and 5 and a corresponding (i+1)-th voltage follower receive gray-scale level signals having opposite polarities in a signal horizontal period. Thus, the voltage follower block 318 delivers the gray-scale level signals so that each odd-numbered data line and each even-numbered data line are driven by gray-scale level signals having opposite polarities and both the data lines are driven alternately by a gray-scale level signal having a positive polarity in a single horizontal period.

Referring to FIG. 5, the P-ROM decoder 316P in the D/A converter block 316 includes a plurality of enhancement pMOSFETs 1P and a plurality of depression pMOSFETs 2P arranged in a matrix with 64 rows (corresponding to gray-scale levels) and 12 columns (corresponding to six bits of the display data). The depression pMOSFET 2P is normally ON, whereas the enhancement pMOSFET 1P is normally OFF. Each enhancement pMOSFET 1P and a corresponding depression pMOSFET 2P connected in series form a pair for representing "0" or "1" of a bit. The order of the enhancement pMOSFET and the depression pMOSFET in each pair follows "0" or "1" of the bit.

Each row includes six pairs of pMOSFETs connected in series and corresponds to one of possible 6-bit gray-scale levels (000000) to (111111). The pMOSFETs in each column have gates connected together, which are applied with a bit DP1 to DP6 or inverted bit /DP1 to /DP6 of a display data. More specifically, the common gates of pMOSFETs in each odd-numbered row are applied with a corresponding one of the bits DP1 to DP6 of the display data, whereas the common gates of pMOSFETs in each even-numbered row are applied with a corresponding one of inverted bits /DP1 to /DP6 of the display data. The source of the pMOSFET in the first column in each row is applied with a gray-scale voltage VP1 . . . VP64 having a positive polarity. The drains of the pMOSFETs arranged in the last column are connected together to the output line of the P-ROM decoder and delivers one of gray-scale voltages VP1 to VP64 as a gray-scale level signal corresponding to the display data to the next stage.

Referring to FIG. 6, the N-ROM decoder 316N in the DIA converter block 316 includes a plurality of enhancement nMOSFETs 1N and a plurality of depression nMOSFETs 2N arranged in a matrix with 64 rows and 12 columns. The depression nMOSFET 2N is normally ON, whereas the enhancement nMOSFET IN is normally OFF. Each enhancement nMOSFET and a corresponding depression nMOSFET connected in series form a pair for representing "0" or "1" of a bit. The order of the enhancement nMOSFET 1N and the depression nMOSFET 2N in each pair follows "0" or "1" of the bit.

Each row includes six pairs of nMOSFETs connected in series and corresponds to one of possible 6-bit gray-scale levels (000000) to (111111). The nMOSFETs in each column have gates connected together, which are applied with a bit DN1 to DN6 or inverted bit /DN1 to /DN6 of a display data. More specifically, the common gates of nMOSFETs in each odd-numbered row are applied with a corresponding one of the bits DN1 to DN6 of the display data, whereas the common gates of nMOSFETs in each even-numbered row are applied with a corresponding one of inverted bits /DN1 to /DN of the display data. The drain of the nMOSFET in the first column in each row is applied with one of gray-scale voltages VN1 . . . VN64 having a negative polarity. The sources of the nMOSFETs arranged in the last column are connected together to the output line of the N-ROM decoder and delivers one of gray-scale voltages VN1 to VN64 as a gray-scale level signal corresponding to the display data to the next stage.

In operation of the decoders 316P and 316N, each row is applied with a corresponding one of gray-scale level voltages VP1 to VP64 or VN1 to VN64 at the first column. On the other hand, the gates of each pair of MOSFETs in the each row are applied with a corresponding bit of a display data and an inverted bit of the display data, respectively. If all the pMOSFETs in one of the rows are ON, the fray-scale level voltage applied to the row is delivered to the next stage block as a gray-scale level signal corresponding to the 6-bit display data.

Referring to FIG. 7 showing the arrangement of the decoders 316P and 316N, the P-ROM decoders 316P and the N-ROM decoders 316N are arranged alternately along the longer side of the semiconductor chip 301. Each P-ROM decoder 316P is disposed in an n-well 12 formed in a p-type semiconductor substrate 11, whereas each N-ROM decoder 316N is disposed in the p-type region of the semiconductor substrate 11.

Each MOSFET arranged in the first column of each decoder 316P or 316N is applied with a corresponding gray-scale voltage VP1, VN1, VP2, VN2 . . . , VP64 or VN64 at the source or drain (marked by a circular dot) thereof All the MOSFETs arranged in the last column in each decoder 316P or 316N are connected together at the drains or sources (each marked by a square dot) thereof to the output line VPO or VNO of each decoder. The output line delivers one of the gray-scale voltages VP1, VN1, . . . , VP64 and VN64 as a gray-scale signal corresponding to the 6-bit display data input thereto.

In the arrangement of the P-ROM decoders 316P and N-ROM decoders 316N as described above, there is a problem in that a relatively large space is necessary between the P-ROM decoder 316P and the adjacent N-ROM decoder 316N, thereby increasing the dimension along the longer side of the semiconductor chip.

In addition, since the signal lines 25P and 25N carrying a positive-polarity voltage and a negative-polarity voltage are mixed in each decoder area, the space between the signal lines 25P and 25N must be large, which increases the dimension along the shorter side of the semiconductor chip 301.

SUMMARY OF THE INVENTION

In view of the above, it is an object of the present invention to provide a drive unit for driving an LCD device in a dot reversible driving scheme, which has smaller dimensions compared to the conventional drive unit as described above.

The present invention provides an LCD driver in a drive unit for driving a plurality of data lines of an LCD panel, the LCD driver comprising a plurality of circuit blocks arranged in an internal circuit of a semiconductor chip, each of the circuit blocks having a data register block including a plurality of data registers each for receiving a display data for one of the data lines, a D/A converter block including a plurality of P-ROM decoders and a plurality of N-ROM decoders each disposed for a corresponding one of the data registers to output an analog gray-scale signal, and an output stage block each disposed for a corresponding one of the P-ROM decoders and the N-ROM decoders, the output stage block driver a corresponding one of the data lines based on an output from a corresponding one of the P-ROM decoders and the N-ROM decoders, and a switching system for switching the display data and the analog gray-scale signal so that adjacent two data lines receive the analog gray-scale signals having opposite polarities and also receive alternately the analog gray-scale signal having a positive polarity and the analog gray-scale signal having a negative polarity, the P-ROM decoders and the N-ROM decoders forming an N-ROM decoder block and a P-ROM decoder block, respectively, which are arranged consecutively along a side of the semiconductor chip.

In accordance with the present invention, although the locations of the P-ROM decoders and the N-ROM decoders do not match with the arrangement of the data lines, the switching system switches the display data and the analog gray-scale signals so that gray-scale signals decoded by the P-ROM decoders and the N-ROM decoders suitably drive the data lines. The arrangement of the P-ROM decodes in the P-ROM decoder block and the N-ROM decoders in the P-ROM decoder block affords reduction of the dimensions of the semiconductor chip.

The above and other objects, features and advantages of the present invention will be more apparent from the following description, referring to the accompanying drawings.

PREFERRED EMBODIMENTS OF THE INVENTION

Now, the present invention is more specifically described with reference to accompanying drawings.

Figure 1:
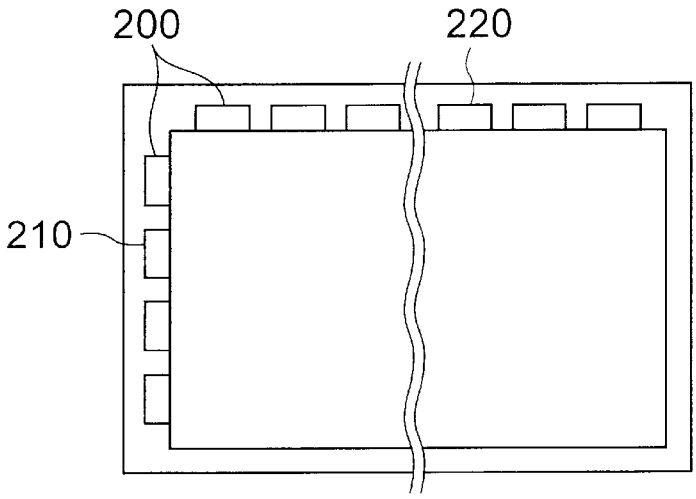
FIG. 1 PRIOR ART
FIG. 1 is a front view of a typical LCD device.
Figure 2:
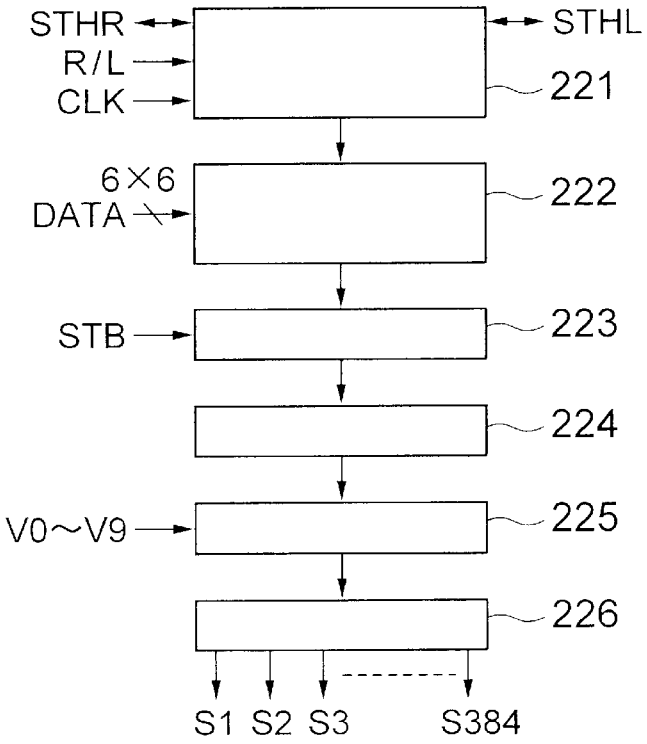
FIG. 2 PRIOR ART
FIG. 2 is a block diagram of a horizontal driver in a conventional drive unit for driving an LCD device in a dot reversible driving scheme.
Figure 3:
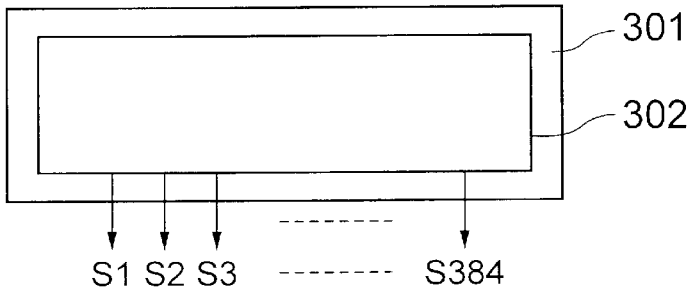
FIG. 3 PRIOR ART
FIG. 3 is a top plan view of a semiconductor chip implementing the horizontal driver shown in FIG. 2.
Figure 4:
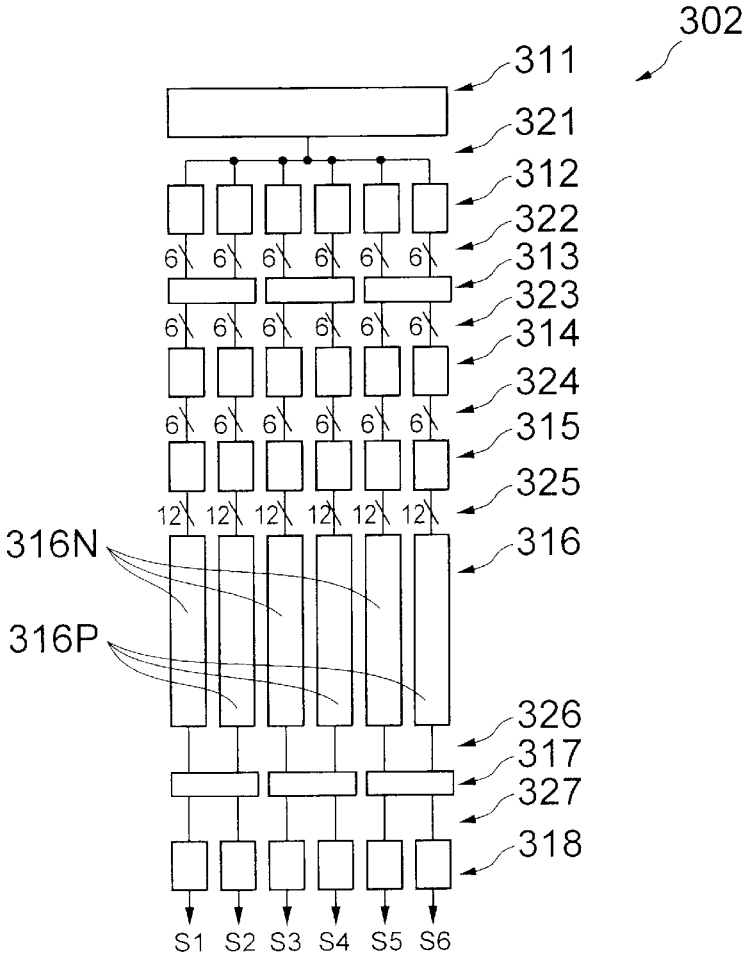
FIG. 4 PRIOR ART
FIG. 4 is a block diagram of the internal circuit shown in FIG. 3.

A drive unit according to a first embodiment of the present invention is used for driving an LCD panel such as shown in FIG. 1. The drive unit includes a horizontal driver and a vertical driver, and the present invention is directed to improvement of the horizontal driver.

Figure 8:
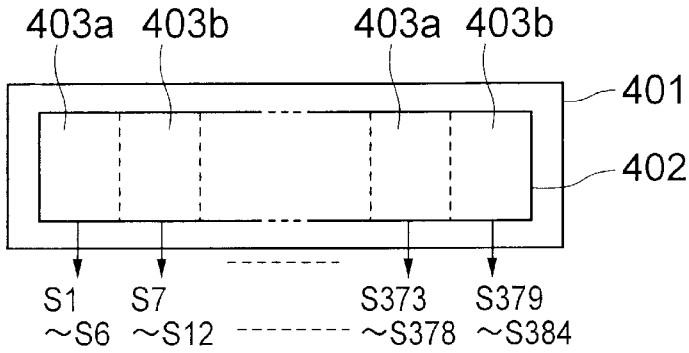
FIG. 8 is a top plan view of a semiconductor chip implementing a horizontal driver in a drive unit for driving a LCD device according to a first embodiment of the present invention.

Referring to FIG. 8, a horizontal driver for use in the driving unit of the present invention is implemented as an internal circuit 402 formed on a semiconductor chip 401 having a rectangular shape. The semiconductor chip 401 has output pads (not shown) arranged in the vicinity of a longer side of the semiconductor chip 401 for driving 384 data lines S1 to S384, input pads for receiving a start pulse, shift direction switching signal, display data, clock signal, latch control signal etc., and source pads for receiving power source and γ-correction sources. These pads are connected to the internal circuit 402. The γ-correction sources are used for correction the gray-scale voltages for adjusting the image quality.

The internal circuit 402 is separated into 64 circuit blocks 403*a* and 403*b* each driving six data lines, wherein the odd-numbered circuit blocks 403*a* have a circuit arrangement which is somewhat different from that of the even-numbered circuit blocks 403*b*.

Figure 9:
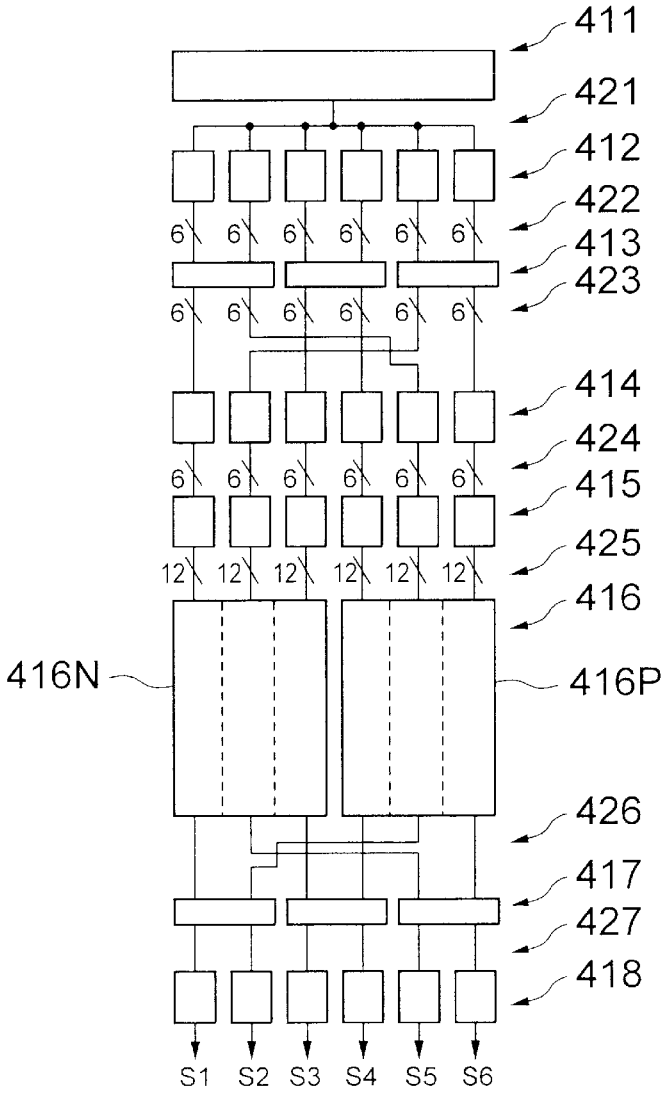
FIG. 9 is a block diagram of the internal circuit shown in FIG. 3.

Referring to FIG. 9 showing the configuration of one of the circuit blocks 403*a*, the circuit block 403*a* includes a signal stage of a shift register 411 corresponding to number N (N=6 in this case) of data lines S1 to S6, a data register block 412 having six registers each corresponding to one of the data lines S1 to S6, a first switch block 413 having three 2-input/2-output switches each for exchanging outputs from a pair of cells in the data register block 412, a latch block 414 having six latch elements each for latching the data output form the first switch block 413 to output latched data at a rising edge of the latch control signal, a level shifter block 415 having six shifter elements each for level-shifting an output from the latch block 414, a D/A converter block 416 having six decoders each for converting an output from the level shifter 415 to deliver an analog display signal, a second switch block 417 having three 2-input/2-output switches each for exchanging outputs from a pair of decoders in the D/A converter block 416, and an output stage block 418 having six voltage followers each for transferring an output from the second switch block 317 to deliver the analog display signal to one of the data lines S1 to S6. These circuit elements in each circuit block 411 to 418 are arranged consecutively in the vicinity of the longer side of the semiconductor chip 401 near the LCD panel.

The shift register 411 generates a control signal, for controlling the data register block 412 to receive display data, by reading a high level of a start pulse at a rising edge of a clock signal. Each data register in the data register block 412 to responds to the control signal to receive a 6-bit display data. Each 2-input/2-output switch in the first switch clock 413 exchanges an output from an odd-numbered data register and an output from a corresponding even-numbered data register at each horizontal period. Each latch element in the latch block 414 latches an output from the first switch clock 413. The D/A converter block 416 includes three N-ROM decoders 416N each for decoding an output from one of first through third latches in the latch block 415 to output a gray-scale signal having a negative polarity, and three P-ROM decoders 416P each for decoding an output form one of fourth to sixth latches in the latch block 415 to output a gray-scale signal having a positive polarity.

As shown in FIG. 9, N-ROM decoders 416N and P-ROM decoders 416P in each odd-numbered circuit block 403*a* are arranged so that first through third N-ROM decoders 416N are disposed for first through third data lines S1 to S3, respectively, and first through third P-ROM decoders 416P are disposed for fourth to sixth data lines S4 to S6, respectively. On the other hand, P-ROM decoders 416P and N-ROM decoders 416N in each even-numbered circuit block 403*b* are arranged so that first through third data lines S1 to S3, respectively, and first through third N-ROM decoders 416N are disposed for fourth to sixth data lines S4 to S6, respectively. Each P-ROM decoder 416P has a 6-bit configuration similar to that described with reference to FIG. 5, whereas each N-ROM decoder 416N has a 6-bit configuration similar to that described with reference to FIG. 6.

Signal line 421 couples an output of a stage of the shift register 411 to inputs of six 6-bit data registers 412, odd-numbered 6-bit signal path 422 couples outputs of a corresponding odd-numbered data register 412 to first inputs of a corresponding switch of the first switch block 413, even-numbered data register to second inputs of a corresponding switch of the first switch clock 413. The 6-bit signal path 423 couples the first switch clock 413 to inputs of the latch block 414 sot that first outputs of the first switch are coupled to the inputs of first 6-bit latch, second inputs of the first switch are coupled to inputs of fifth 6-bit latch, first inputs of second switch are coupled to inputs of third 6-bit latch, first inputs of third switch are coupled to the inputs of second 6-bit latch, and second inputs of third switch are coupled to inputs of sixth 6-bit latch.

6-bit signal path 424 couples the output of each latch in the latch in the latch block 414 to the input of a corresponding level shifter in the level shifter block 415. 12-bit signal path 425 couples the level shifter block 415 to the inputs of D/A converter 416 so that outputs of first through third N-ROM decoders 416N, respectively, and outputs of fourth through sixth level shifters are coupled to inputs of first through third P-ROM decoders 416P, respectively.

Signal lines 426 couples the outputs of D/A converter 416 to the inputs of second switch block 417 so that outputs of first through third N-ROM decoders 416N are coupled to first inputs of first switch, third switch, and second switch, respectively, and outputs of P-ROM decoders 416P are coupled to second inputs of second switch, first switch block 417 to inputs of output stage block so that first and second outputs of first switch are coupled to inputs of first and second voltage followers which respectively drive data lines S1 and S2, first and second outputs of second switch are coupled to inputs of third and fourth voltage followers which respectively drive data lines S3 and S4, and first and second outputs of third switch are coupled to inputs of fifth and sixth voltage followers which respectively drive data lines S5 and S6. In the circuit block 403*b,* the N-ROM 416N decoders and P-ROM decoders 416P are reversed from the configurations shown in FIG. 9, with the other configurations are similar to those shown in FIG. 9.

In operation of the circuit block 403*a,* if a right-shift operation is selected in the shift register 411 in a circuit block 403*a,* a high level of the start pulse is received by the first register 411 at a rising edge of the clock pulse in each horizontal period, and is output to the next stage circuit block 403*b* for operation the next stage circuit block 403*b* for right shift operation. At the same time, a control signal for receiving display data is delivered to the six data registers in the data register block 412. Thus, all the data registers respectively receive 6-bit display data during each horizontal period. Each odd-numbered data register delivers the 6-bit display data to the first inputs of a corresponding switch in the first switch block 413, whereas each even-numbered data register delivers the 6-bit display data to the second inputs of a corresponding switch. At this stage of operation, if i-th data register receives display data for i-th data line in the circuit block 403*a,* then in the circuit block 403*b,* each odd-numbered (i-th) data register receives display data for a corresponding even-numbered ((i+1)th) data line and each even-numbered ((i+1)th) data register receives display data for a corresponding odd-numbered data line (i-th), and vice versa.

The display data fed to the first and second inputs of first switch in the first switch block 413 are alternately delivered to first and fifth latches in the latch block 414. The display data fed to the first and second inputs of second switch are alternately delivered to third and fourth latches. The display data fed tot he first and second inputs of third switch are alternately delivered to second and sixth latches. The display data are delivered at once in a horizontal period form first through sixth latches in the latch block 414 through the level shifter block 415 to first through third N-ROM decoders 416N and first through third P-ROM decoders 416P, respectively, in the D/A converter block 416. This applies to the circuit block 403*a*. On the other hand, in the circuit block 403*b,* the display data are delivered from first through sixth latches to first through third P-ROM decoders 416P and first through third N-ROM decoders 416N, respectively.

Each decoder in the D/A converter 416 generates a 64-level gray-scale display signal based on the 6-bit display data supplied thereto. First through third N-ROM decoders 416N deliver the gray-scale signals having a negative polarity tot he first inputs of first, third and second switches, respectively, whereas first through third P-ROM 416P decoders deliver the gray-scale signals having a positive polarity to the second inputs of second, first and third switches in the second switch block 417.

The three switches in the second switch block 417 deliver gray-scale signals through the voltage followers to the data lines S1 to S6 so that each odd-numbered data line S1, S3 or S5 and each even-numbered data line S2, S4, or S6 deliver gray-scale signals having different polarities and so that the gray-scale signals having different polarities and so that the gray-scale signal on each of the data lines S1 to S6 changes the polarity thereof at each horizontal period.

Figure 10:
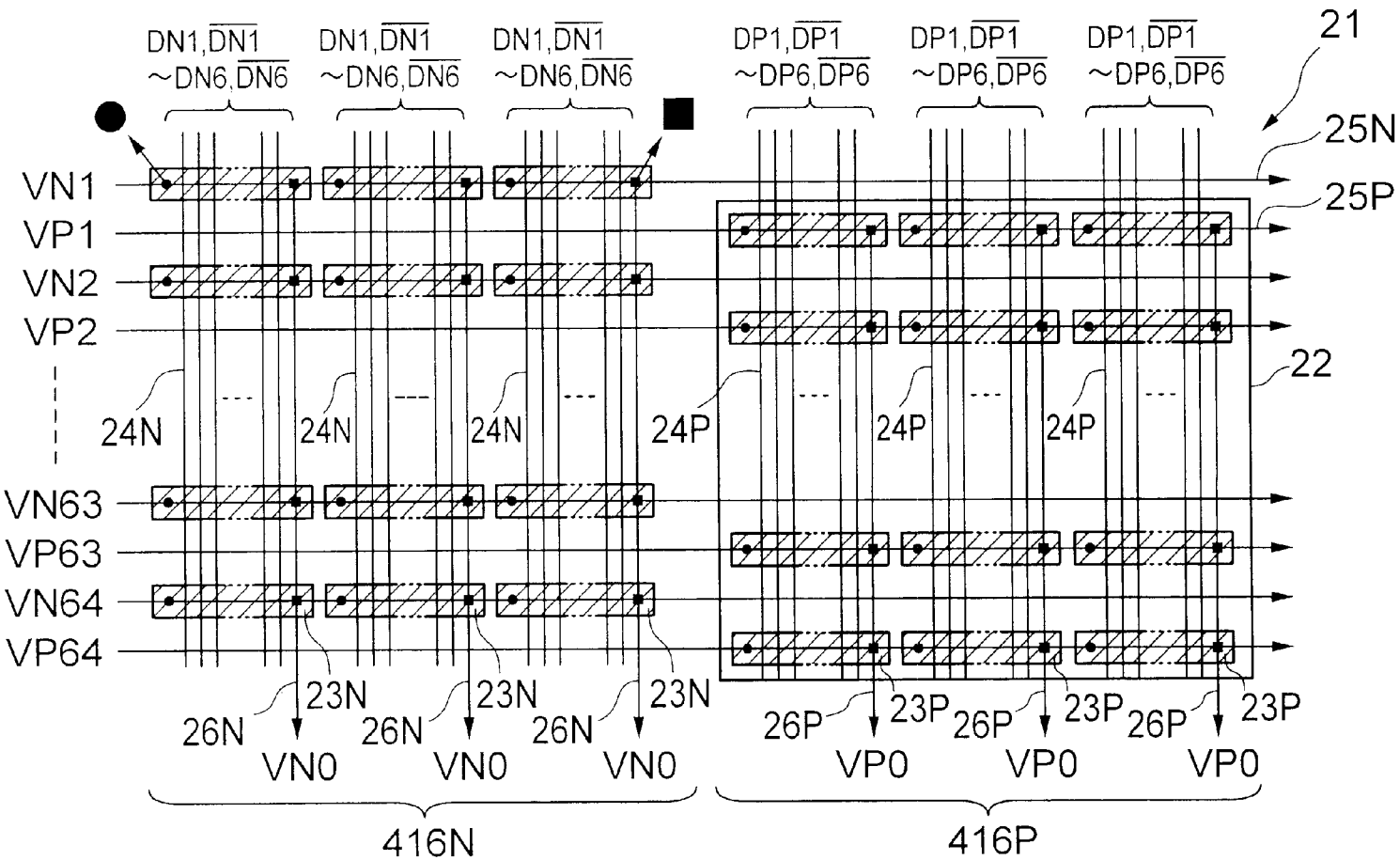
FIG. 10 is a top plan view of the decoders shown in FIG. 4.

Referring to FIG. 10 showing a schematic pattern configuration of decoders in the D/A converter block 416 in the circuit block 403*a,* a P-ROM decoder block including three P-ROM decoders 416P each having 12×64 transistors for a 6-bit configuration is disposed in the right-hand side of the figure. An N-ROM decoder block including three N-ROM decoders each having 12×64 transistors for a 6-bit configuration is disposed in the left-hand side of the figure. Each row of the P-ROM decoders 416P and each row of the N-ROM decoders 416N are disposed alternately in the column direction, forming 64 rows for each of the P-ROM decoder 416P and the N-ROM decoder 416N.

P-type diffused regions 23P are arranged in a 3×64 matrix in an n-well 22 formed in a p-type semiconductor substrate 21, each of the p-type diffused regions 23P acting as source/drains for 12 pMOS transistors. Six pairs of gate electrode lines 24P pass over each p-type diffused region 23P in the column direction. First pMOS transistors in a group of p-type diffused regions 23P arranged in a row are connected together at their source regions (each marked by a circular dot) and connected to a corresponding voltage source VP1, VP2, . . . or VP64 by a metallic line 25P. Last pMOS transistors in the p-type diffused regions of the P-ROM decoder 416P arranged in a column are connected together at their drain regions (each marked by a square dot) by a metallic line 26P, which delivers a gray-scale signal VPO having a positive polarity to a corresponding data line.

N-type diffused regions 23N are arranged in a 3×64 matrix in the p-type region of the semiconductor substrate 21, each of the n-type diffused regions 23N acting as source/drains for 12 nMOS transistors. Six pairs of gate electrodes 24N pass over each n-type diffused region 23N in the column direction. First nMOS transistors in a group of n-type diffused regions arranged in a row are connected together at their drain regions (each marked by a circular dot) and connected to a corresponding voltage source VN1, VN2, . . . or VN64 by a metallic line 25N. Last nMOS transistors in the n-type diffused regions of the N-ROM decoder 416N arranged in a column are connected together at their source regions (each marked by a square dat) by a metallic line 26N, which delivers a gray-scale signal VNO having a negative polarity tot a corresponding data line.

In the circuit block 403*b,* the arrangement of the P-ROM decoders 416P and the N-ROM decoders 416N are reversed form that shown in FIG. 10. The arrangement of the circuit block 403*b* is in a mirror-symmetry with respect to the arrangement of the circuit block 403*a*. This enables two adjacent P-ROM decoder blocks (or two adjacent N-ROM decoder blocks) in adjacent two circuit blocks 403*a* and 403*b* to be disposed in a single n-well (or disposed as a single block).

In an alternative, each two adjacent P-ROM decoders (or N-ROM decoders) disposed in a row in each decoder block may be disposed in a mirror-symmetry with respect to each other, wherein the diffused regions may be common for the last transistor in one of the decoders and the first transistor in the other of the decoders.

Figure 7:
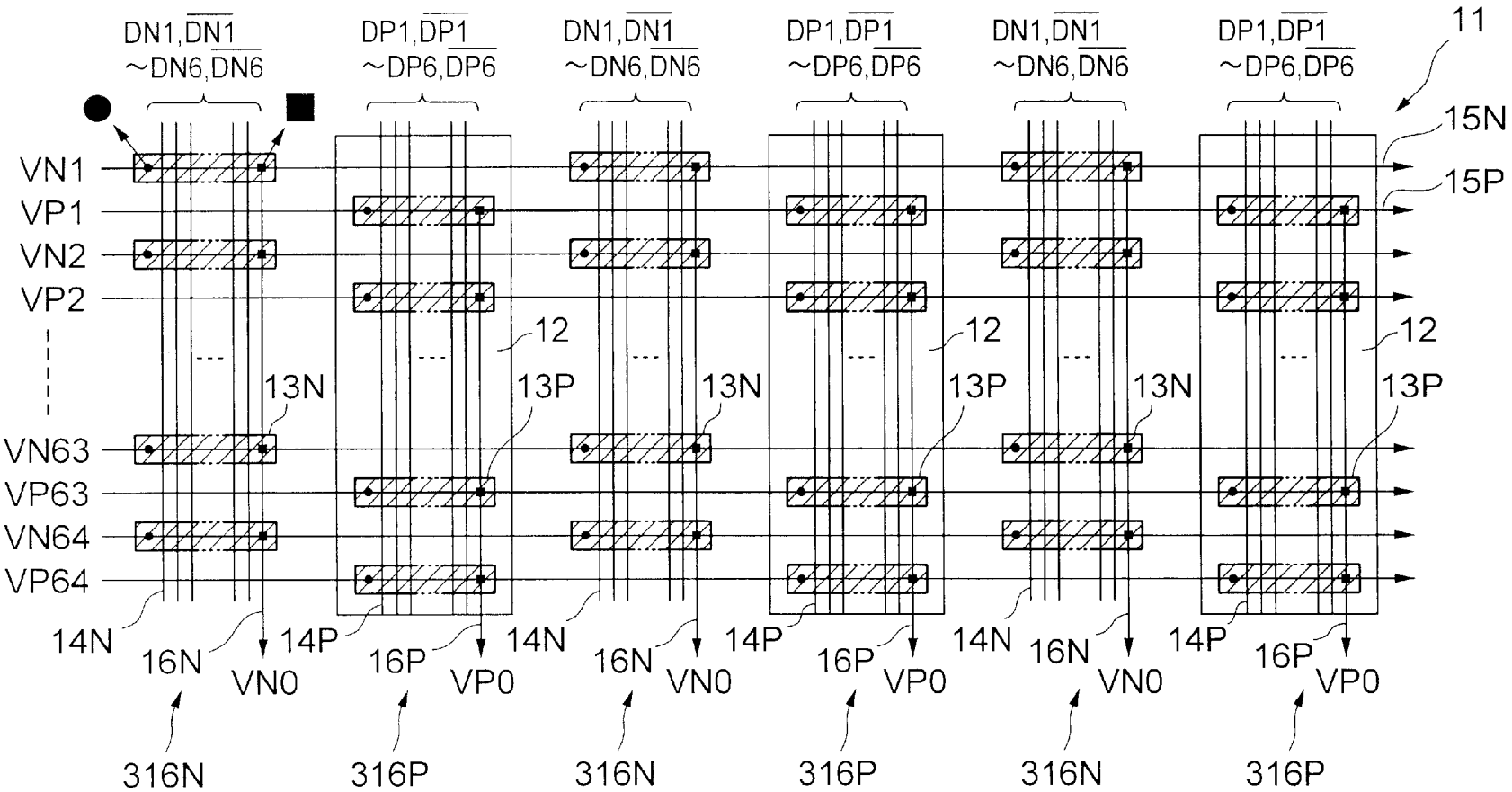
FIG. 7 PRIOR ART
FIG. 7 is a schematic top plan view of the decoders shown in FIGS. 4, 5 and 6.

The block arrangement of the P-ROM decoders 416P and the N-ROM decoders 416N as described above can save the space for the semiconductor chip, especially in the direction for the longer side thereof. For example, the conventional arrangement for P-ROM decoders and N-ROM decoder, shown in FIG. 7, includes 383 interfaces between P-ROM decoders 316P and adjacent N-ROM decoders 316N in a drive unit for driving 384 data lines. Assuming that the space or length necessary for the interface is 50 $\mu$m, the total length for the interfaces is about 19 mm (383×50 $\mu$m). On the other hand, in the present embodiment, since there is only one interface between the P-ROM decoder 416P and the N-ROM decoder 416N in each circuit block, the total length for the interfaces for 64 circuit blocks is about 3 mm (64×50 $\mu$m), which is reduced down to 20% of the total length of the interfaces in the conventional drive unit.

Figure 11:
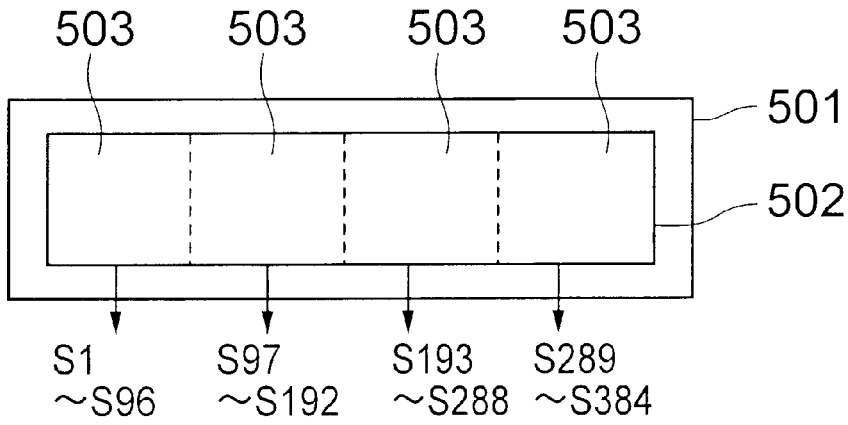
FIG. 11 is a top plan view of a semiconductor chip implementing a horizontal driver in a drive unit according to a second embodiment of the present invention.

Referring to FIG. 11 showing a horizontal driver, similarly to FIG. 8, in a driving unit according to a second embodiment of the present invention, the horizontal driver is depicted as driving 384 data lines similarly to the first embodiment. The internal circuit 502 in the semiconductor chip 501 is separated into four circuit clocks 503 in the direction of the longer sides of the chip, each of the circuit block 503 driving 96 data lines. The second embodiment achieves especially reduction of the length along the shorter side of the semiconductor chip.

Each circuit block has a configuration similar to the configuration of the circuit block 403*a* shown in FIG. 9 except for the number (96 in the present embodiment) of data lines to be driven by each circuit block. The large number of data lines involves a problem of a larger space for the D/A converter; however, the problem can be solved by the configuration described in Japanese Patent Application No. Hei-10-308800.

Figure 5:
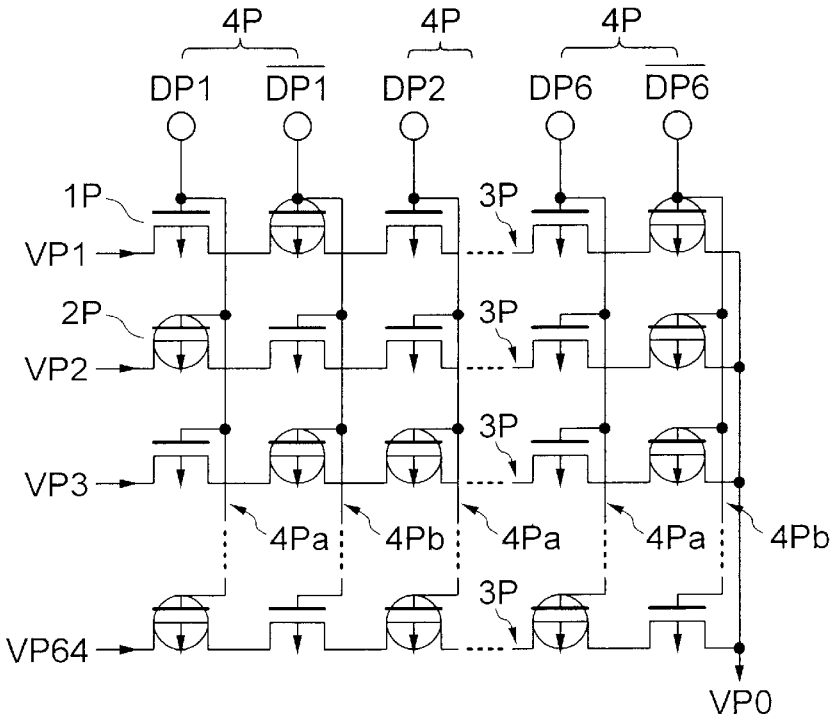
FIG. 5 PRIOR ART
FIG. 5 is a circuit diagram of the P-ROM decoder shown in FIG. 4.
Figure 6:
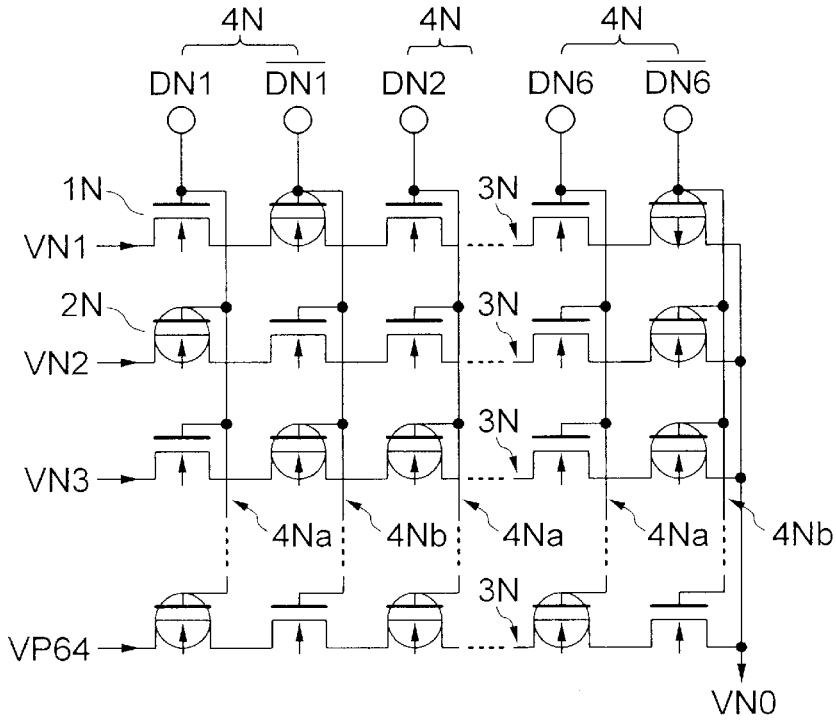
FIG. 6 PRIOR ART
FIG. 6 is a circuit diagram of the N-ROM decoder shown in FIG. 4.
Figure 12:
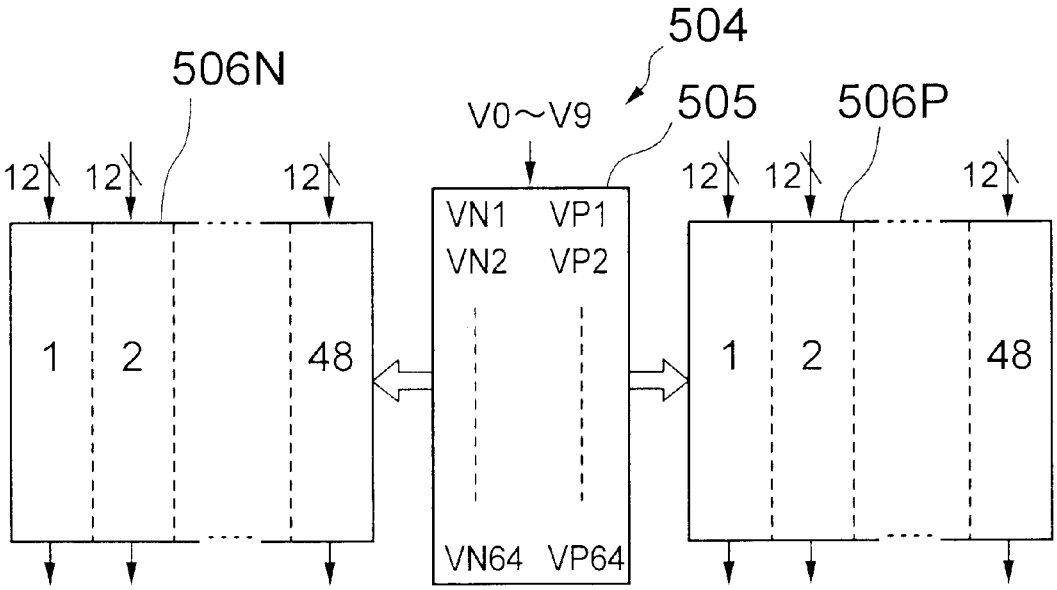
FIG. 12 is a block diagram of the D/A converter block shown in FIG. 11.

Referring to FIG. 12, the D/A converter 504 disposed in each circuit block 503 of FIG. 11 includes a P-ROM decoder block having 48 P-ROM decoders 506P for driving 48 data lines, an N-ROM decoder block having 48 N-ROM decoders 506N for driving other 48 data lines and a gray-scale voltage generator 505 disposed between the P-ROM decoder block and the N-ROM decoder block for generation 64-level gray-scale voltages having a negative polarity. The arrangements of the P-ROM decoders 506P in the P-ROM decoder block and the N-ROM decoders 506N int eh N-ROM decoder block are similar to those such as shown in FIG. 5 and FIG. 6, Respectively.

Figure 13:
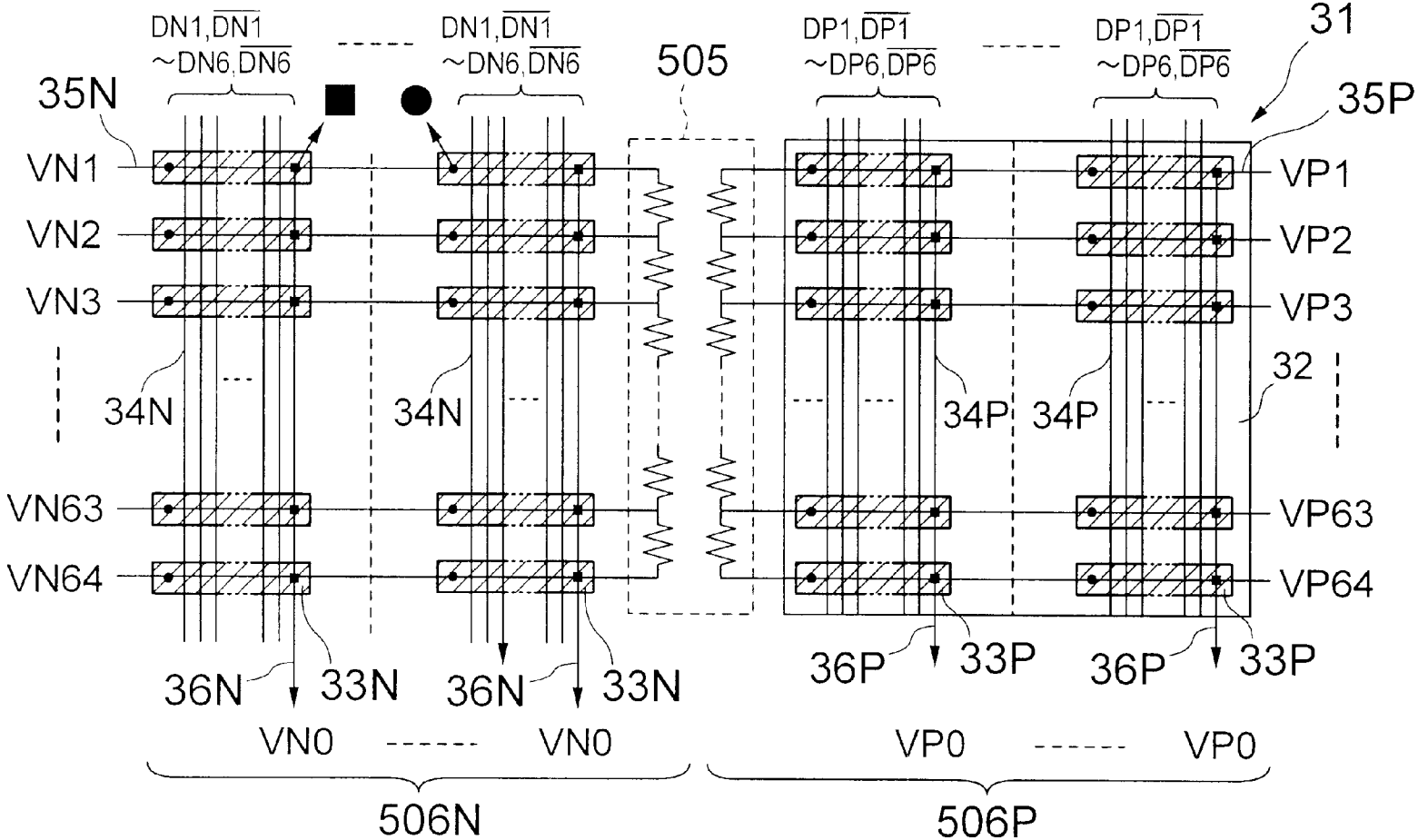
FIG. 13 is a schematic top plan view of the decoders in the D/A converter block shown in FIG. 12.

Referring to FIG. 13 showing the schematic arrangement of the D/A converter 504 of FIG. 12, the gray-scale voltage generator 505 includes a resistor ladder delivering a gray-scale level voltage at each node of the resistor ladder. The resistor ladder is implemented by polysilicon resistors. The P-ROM decoder block includes 48 P-ROM decoders 506P disposed in an n-well 32 and arranged in the row direction. Each P-ROM decoder includes 64×12 pMOS transistors, including p-type diffused regions 33P and gate liens 34P. First pMOS transistors in the p-type diffused regions 33P of the P-ROM decoder 506P arranged in a row are connected together at their sources (each marked by a circular dot) and connected to a corresponding node of the gray-scale voltage generator 505 by a metallic line 35P. Last transistors in the p-type diffused regions arranged in a column are connected together at their drains (each marked by a square dot) by a metallic line 368, which delivers a decoded output having a positive polarity.

The N-ROM decoder block includes 48 N-ROM decoders 506N disposed in the p-type region of the semiconductor substrate 31 and arranged in the row direction. Each N-ROM decoder 506N includes 64 n-type diffused regions 33N arranged in the column direction and each including 12 nMOS transistors. First nMOS transistors in the n-type diffused regions 33N arranged in a row are connected together at their drains (each depicted by a circular dot) and connected to a corresponding node of the gray-scale voltage generator 505 by a metallic line 35N. Last transistors in the n-type diffused regions 33N arranged in a column are connected together at their sources (each depicted by a square dot) by a metallic line 36N, which delivers a decoded output having a negative polarity.

In both the decoder blocks, the drain of the first transistor in a decoder and the source of the last transistor in the adjacent decoder are disposed adjacent to each other. However, adjacent two decoders in each of the decoder blocks may be arranged in a mirror-symmetry with respect to each other so that a common diffused region is provided for each column of the adjacent decoder.

In the second embodiment, each row of the P-ROM decoder is aligned with a corresponding row of the N-ROM decoder; however, each row may include either P-ROM decoder or N-ROM decoder.

In the above arrangement of the second embodiment, wherein P-ROM decoders and N-ROM decoders are disposed as a pair of blocks sandwiching therebetween the gray-scale voltage generator 505, affords a smaller space between the decoders in the column direction because each block receives only a positive or negative voltage for the gray-scale levels.

In addition, the gray-scale voltage generator 505 disposed between the P-ROM decoder block and the N-ROM decoder block renders a large space therebetween to be unnecessary. Moreover, the number of the interfaces between the P-ROM decoder and the N-ROM decoder is only three in the drive unit for driving 384 data lines. This reduces the space between the P-ROM decoder and the N-ROM decoder int eh row direction. Assuming that the length of the space between the P-ROM decoder and the N-ROM decoder should be 50 $\mu$m, the total length for the interface is about 0.15 mm compared to the conventional D/A converter which involves about 19 mm for the space.

Furthermore, the space between the p-type diffused region and the n-type diffused region can be saved.

According to the above embodiments, the longer side of the semiconductor chip can be reduced. The space saved for the longer side may be used for reducing the shorter side of the semiconductor chip. For example, in the first and second embodiments, the configuration of each decoder is shown in FIG. 5 or 6; however, the configuration may be replaced for reduction of the shorter side by using a configuration such as proposed by Japanese Patent Application No. Hei-10-335615.

The mirror-symmetry arrangement between the odd-numbered circuit block and the even-numbered circuit block is only an example, and the mirror-symmetry arrangement may be replaced by the same arrangement of these circuit blocks.

In the first embodiment, the sandwich arrangement of the gray-scale voltage generator as employed in the second embodiment may be used.

Furthermore, the semiconductor substrate may be an n-type substrate, wherein the N-ROM decoders are disposed in a p-well formed on the n-type semiconductor substrate.

Since the above embodiments are described only for examples, the present invention is not limited to the above embodiments and various modifications or alterations can be easily made therefrom by those skilled in the art without departing from the scope of the present invention.

What is claimed is:

1. An LCD driver in a drive unit for driving a plurality of data lines of an LCD panel, said LCD driver comprising:

a plurality of circuit blocks arranged in an internal circuit of a semiconductor chip, each of said circuit blocks having a data register block including a plurality of data registers each for receiving a display data for one of the data lines, a D/A converter block including a plurality of P-ROM decoders and a plurality of N-ROM decoders each disposed for a corresponding one of said data registers to output an analog gray-scale signal, and an output stage block each disposed for a corresponding one of said P-ROM decoders and said N-ROM decoders, said output stage block driving a corresponding one of the data lines based on an output from a corresponding one of said P-ROM decoders and said N-ROM decoders, and a switching system for switching the display data and the analog gray-scale signal so that adjacent two data lines receive the analog gray-scale signals having opposite polarities and also receive alternately the analog gray-scale signal having a positive polarity and the analog gray-scale signal having a negative polarity, said plurality of P-ROM decoders and said plurality of N-ROM decoders forming a N-ROM decoder block and a P-ROM decoder block, respectively, which are arranged consecutively along a side of the semiconductor chip.

2. The LCD driver of claim 1, wherein said P-ROM decoders in adjacent two of said circuit blocks are disposed in a mirror-symmetry with respect to each other, and said N-ROM decoders in adjacent two of said circuit blocks are disposed in a mirror-symmetry with respect to each other.

3. The LCD driver of claim 1, wherein one of said P-ROM decoder and said N-ROM decoder is disposed in a well and the other of said P-ROM decoder and said N-ROM decoder is disposed in a substrate region of the semiconductor chip.

4. The LCD driver of claim 3, wherein said one of said P-ROM decoder and said N-ROM decoder in one of said circuit blocks and said one of said P-ROM decoder and said N-ROM decoder in an adjacent one of said circuit blocks are disposed in a single well.

5. The LCD driver of claim 1, wherein one of said P-ROM decoder and said N-ROM decoder outputs the analog gray-scale signal having a positive polarity and the other of said P-ROM decoder and said N-ROM decoder outputs the analog gray-scale signal having a negative polarity.

6. The LCD driver as defined in claim 1, wherein each of said PROM decoder and said NROM decoder includes a plurality of rows each corresponding to one of possible gray-scale voltage levels, and each of said rows includes a plurality of pairs of MOSFETs connected in series, said pair including an enhancement MOSFET and a depletion MOSFET connected in series.

7. The LCD driver of claim 1, wherein said P-ROM decoder block and said N-ROM decoder block sandwich therebetween a gray-scale voltage generator.

8. The LCD driver of claim 7, wherein a row of said P-ROM decoder is aligned with a corresponding row of said N-ROM decoder.

9. The LCD device as defined in claim 7, wherein said gray-scale voltage generator includes a resistor ladder formed by a polysilicon film.

10. The LCD device as defined in claim 1, wherein the LCD device is implemented on a single semiconductor chip.

11. The LCD driver of claim 1, wherein the plurality of P-ROM decoders are adjacent to each other along a longer side of the semiconductor chip.

12. A D/A converter block for an LCD driver, the D/A converter block comprising:

a P-ROM decoder block including a plurality of P-ROM decoders, wherein each one of said plurality of P-ROM decoders comprises a plurality of P-MOSFETs; and a N-ROM decoder block including a plurality of N-ROM decoders, wherein each one of said plurality of N-ROM decoders comprises a plurality of N-MOSFETs.

13. The D/A converter of claim 12, wherein said P-ROM decoders in adjacent two of said circuit blocks are disposed in a mirror-symmetry with respect to each other, and said N-ROM decoders in adjacent two of said circuit blocks are disposed in a mirror-symmetry with respect to each other.

14. The D/A converter of claim 12, wherein one of said P-ROM decoder and said N-ROM decoder is disposed in a well and the other of said P-ROM decoder and said N-ROM decoder is disposed in a substrate region of the semiconductor chip.

15. The D/A converter of claim 14, wherein said one of said P-ROM decoder and said N-ROM decoder in one of said circuit blocks and said one of said P-ROM decoder and said N-ROM decoder in an adjacent one of said circuit blocks are disposed in a single well.

16. The D/A converter of claim 12, wherein one of said P-ROM decoder and said N-ROM decoder outputs the analog gray-scale signal having a positive polarity and the other of said P-ROM decoder and said N-ROM decoder outputs the analog gray-scale signal having a negative polarity.

17. The D/A converter of claim 12, wherein each of said P-ROM decoder and said N-ROM decoder includes a plurality of rows each corresponding to one of possible gray-scale voltage levels, and each of said rows includes a plurality of pairs of MOSFETs connected in series, said pair including an enhancement MOSFET and a depression MOSFET connected in series.

18. The D/A converter block of claim 12, further comprising a gray-scale voltage generator sandwiched between said P-ROM decoder block and said N-ROM decoder block.

19. The D/A converter of claim 18, wherein a row of said P-ROM decoder is aligned with a corresponding row of said N-ROM decoder.

20. The D/A converter of claim, wherein said gray-scale voltage generator includes a resistor ladder formed by a polysilicon film.

* * * * *